US010982356B2

(12) United States Patent
Enqvist et al.

(10) Patent No.: US 10,982,356 B2
(45) Date of Patent: Apr. 20, 2021

(54) INDUSTRIAL TEXTILE

(71) Applicant: VALMET TECHNOLOGIES OY, Espoo (FI)

(72) Inventors: Rauno Enqvist, Espoo (FI); Juha Paavolainen, Espoo (FI)

(73) Assignee: VALMET TECHNOLOGIES OY, Espoo (FI)

( * ) Notice: Subject to any disclaimer, the term of this patent is extended or adjusted under 35 U.S.C. 154(b) by 137 days.

(21) Appl. No.: 16/479,325

(22) PCT Filed: Mar. 21, 2018

(86) PCT No.: PCT/FI2018/050211
§ 371 (c)(1),
(2) Date: Jul. 19, 2019

(87) PCT Pub. No.: WO2018/172615
PCT Pub. Date: Sep. 27, 2018

(65) Prior Publication Data

US 2019/0382928 A1 Dec. 19, 2019

(30) Foreign Application Priority Data

Mar. 24, 2017 (FI) ..... 20175281

(51) Int. Cl.
*D03D 3/04* (2006.01)
*D03D 1/00* (2006.01)
(Continued)

(52) U.S. Cl.
CPC ..... *D03D 1/0094* (2013.01); *D03D 1/02* (2013.01); *D03D 3/04* (2013.01); *D21F 1/0036* (2013.01); *D21F 1/10* (2013.01); *D21F 7/08* (2013.01)

(58) Field of Classification Search
CPC ..... D03D 1/0094; D03D 1/02; D03D 3/04; D03D 11/00; D03D 11/02; D03D 13/00;
(Continued)

(56) References Cited

U.S. PATENT DOCUMENTS 3,957,090 A * 5/1976 Muhlen ..... B31F 1/2845 139/409
5,103,874 A * 4/1992 Lee ..... D21F 1/0036 139/383 A
(Continued)

FOREIGN PATENT DOCUMENTS

CN 1179482 4/1998
CN 1186132 7/1998
(Continued)

*Primary Examiner* — Robert H Muromoto, Jr.
(74) *Attorney, Agent, or Firm* — Leason Ellis LLP

(57) ABSTRACT

An industrial textile (1) having a longitudinal direction (MD) and a cross direction (CMD) and a first surface and a second surface, the industrial textile (1) extending in the cross direction from a first edge (E1) to a second edge (E2). The industrial textile (1) has a double warp which comprises a first warp having first machine direction yarns (U1, U2) and a second warp having second machine direction yarns (LI, L2). The yarns (U1, U2) of the first warp are arranged above the yarns (LI, L2) of the second warp and the yarns of the first warp are at least partially offset in respect of the yarns of the second warp. The industrial textile has a weft having cross machine direction yarns (W1, W2, W3, W4). The yarns (U1, U2) of the first warp and the yarns (W1, W2, W3, W4) of the weft bind themselves to each other according to a first predetermined pattern and the yarns (LI, L2) of the second warp and the yarns (W1, W2, W3, W4) of the weft bind themselves to each other according to a second predetermined pattern. The first predetermined pattern and the second predetermined pattern form a textile structure which has the cross machine direction yarns (W1, W2, W3,
(Continued)

W4) at least on two different levels in the thickness direction of the industrial textile (1).

6 Claims, 2 Drawing Sheets

(51) Int. Cl.

| | |
|---|---|
| ***D03D 1/02*** | (2006.01) |
| *D03D 25/00* | (2006.01) |
| *D21F 1/00* | (2006.01) |
| *D21F 1/10* | (2006.01) |
| *D21F 7/08* | (2006.01) |

(58) Field of Classification Search
CPC ..... D03D 13/004; D03D 2700/0162; D21F 1/0036; D21F 1/10; D21F 7/08; D21F 1/0027; D21F 7/083; D21F 1/0045; Y10S 162/902
See application file for complete search history.

(56) References Cited

U.S. PATENT DOCUMENTS 5,167,261 A * 12/1992 Lee ..... D21F 1/0036 139/383 A
5,199,467 A * 4/1993 Lee ..... D21F 1/0036 139/383 A
5,230,371 A * 7/1993 Lee ..... D21F 1/0036 139/383 A
5,343,896 A * 9/1994 Schroder ..... D21F 1/0036 139/383 A
5,690,149 A * 11/1997 Lee ..... D21F 1/0036 139/383 A
6,155,308 A * 12/2000 Kuji ..... D21F 1/0027 139/383 R
H1974 H * 7/2001 Lee ..... 139/20
6,273,146 B1 * 8/2001 Herring ..... D21F 1/0054 139/383 AA
6,563,169 B1 5/2003 Miyakoshi et al.
6,742,548 B2 * 6/2004 Enqvist ..... D21F 1/0027 139/383 A
7,216,677 B2 * 5/2007 Fujisawa ..... D21F 1/0036 139/383 A
7,270,151 B2 * 9/2007 Nagura ..... D21F 1/0036 139/383 A
7,270,152 B2 * 9/2007 Ueda ..... D21F 1/0036 139/383 A
7,306,014 B2 * 12/2007 Nagura ..... D21F 1/0036 139/383 A
7,357,157 B2 * 4/2008 Ueda ..... D21F 1/0036 139/383 A
7,426,943 B2 * 9/2008 Ueda ..... D21F 1/0036 139/383 A
7,484,537 B2 * 2/2009 Ueda ..... D21F 1/0036 139/383 A
7,617,846 B2 11/2009 Ding
7,874,322 B2 * 1/2011 Ueda ..... D21F 1/0045 139/383 A
7,882,857 B1 * 2/2011 Ueda ..... D21F 1/0036 139/383 A
8,205,644 B2 * 6/2012 Ueda ..... D21F 1/0036 139/383 A
2003/0066935 A1 * 4/2003 Enqvist ..... D21F 1/0027 245/5
2004/0261883 A1 * 12/2004 Harrison ..... D03D 13/004 139/383 A
2005/0067040 A1 * 3/2005 Quigley ..... D21F 1/0045 139/383 A
2006/0040578 A1 * 2/2006 Nagura ..... D21F 1/0036 442/239
2006/0048839 A1 * 3/2006 Fujisawa ..... D21F 1/0036 139/383 A
2006/0102244 A1 * 5/2006 Ueda ..... D21F 1/0036 139/383 A
2006/0116042 A1 * 6/2006 Nagura ..... D21F 1/0036 442/205
2006/0278295 A1 * 12/2006 Ueda ..... D21F 1/0036 139/383 A
2006/0278297 A1 * 12/2006 Ueda ..... D21F 1/0036 139/383 A
2007/0068591 A1 * 3/2007 Ward ..... D21F 1/0036 139/383 A
2007/0095416 A1 * 5/2007 Ueda ..... D21F 1/0036 139/383 A
2010/0196670 A1 * 8/2010 Ueda ..... D21F 1/0036 428/172
2011/0011485 A1 * 1/2011 Ueda ..... D21F 1/0036 139/383 A

FOREIGN PATENT DOCUMENTS

| | | |
|---|---|---|
| CN | 1429298 | 7/2003 |
| CN | 1457379 | 11/2003 |
| CN | 1863964 | 11/2006 |
| CN | 101351592 | 1/2009 |
| CN | 205603959 | 9/2016 |
| FI | 113070 | 2/2004 |
| GB | 2 424 227 | 9/2006 |
| JP | 2011069016 | 4/2011 |
| WO | WO 9104374 | 4/1991 |
| WO | WO 2004/076742 | 9/2004 |
| WO | WO 2006/096977 | 9/2006 |
| WO | WO 2011/022831 | 3/2011 |
| WO | WO 2016/151189 | 9/2016 |

* cited by examiner

INDUSTRIAL TEXTILE

CROSS-REFERENCE TO RELATED PATENT APPLICATIONS

This application is a U.S. National Phase Application under 35 U.S.C. § 371 of International Patent Application No. PCT/FI2018/050211, filed Mar. 21, 2018, which claims the priority of Finnish Patent Application No. 20175281, filed Mar. 24, 2017, each of which is incorporated by reference as if expressly set forth in its entirety herein.

FIELD OF THE INVENTION

The present invention relates to an industrial textile having a longitudinal direction and a cross direction and a first surface and a second surface. The industrial textile extends in the cross direction from a first edge to a second edge.

BACKGROUND OF THE INVENTION

The known industrial textiles have weft yarns in one plane in their thickness direction which maximizes the area which is perpendicular to a jet of a high pressure washing liquid and thus, the jet cannot penetrate in the textile sufficiently. This results in an inadequate washing result and damaged yarns.

The inadequate washing result has led to higher pressures (500 to 600 bar) during the washing process which makes the damages of the yarns even worse. The fibrils of the damaged yarns fill the structure between the yarns of the industrial textile, thus decreasing the air permeability of the textile. This may lead to runnability problems. Further, the machines for high pressure washing are expensive and vulnerable.

BRIEF DESCRIPTION OF THE INVENTION

An object of the present invention is to provide an industrial textile which overcomes the above problems. The objects of the invention are achieved by the industrial textile which is characterized by what is stated in the independent claims. The preferred embodiments of the invention are disclosed in the dependent claims.

The industrial textile of the invention has such structure that it receives a large amount of washing liquid and the washing liquid penetrates easily into the structure. Further, collecting dirt and residues of the washing liquid after the washing process is enhanced.

Further, according to an idea the first surface of the industrial textile has such topography that dirt does not easily fill up the surface.

Even further, according to an idea damages of the yarns of the industrial textile which are in contact with the jets of the washing liquid are decreased.

The industrial textile of the invention is mainly used on paper, pulp or cartonboard machines on forming, press or drying sections, i.e. the industrial textile may be a forming fabric, a fabric on a press section, or a dryer fabric. One of the preferred uses of the industrial textile is in the manufacture of container board. Further, the industrial textile is usable in other processes in which high ability for removing liquid, e.g. water, is required, such as filtration, i.e. the industrial textile is a filter fabric.

The industrial textile has a longitudinal direction and a cross direction, i.e. a warp direction and a weft direction, respectively. The industrial textile has a first surface which in use is in contact with the material to be processed, such as paper or pulp. The second surface of the industrial textile faces towards machine parts, such as rolls of a paper machine. The industrial textile extends from the first edge to the second edge in the cross direction of the industrial textile. In use the industrial textile forms an endless rotating loop.

The industrial textile comprises a double warp, i.e. there are two warps one above the other. A first warp comprises first machine direction yarns and a second warp comprises second machine direction yarns. The yarns of the first warp are arranged above the yarns of the second warp. The first machine direction yarns of the first warp and the second machine direction yarns of the second warp may be flat yarns.

The yarns of the first warp are at least partially offset in respect of the yarns of the second warp which means that at least part of the yarns of the first warp are shifted laterally in respect of the yarns of the second warp. However, it is possible that all yarns of the first warp are offset in respect of the yarns of the second warp. The warp cover of each warp is preferably from 75 to 95%.

Cleaning of the industrial textile is enhanced due to the overlapping first and second warp yarns because slits and channels are formed between the warp yarns. Dirt does not accumulate easily on the first surface of the industrial textile during its use in an industrial process. When the industrial textile is washed a jet of a high pressure washing liquid penetrate into the structure of the industrial textile due to the slits and channels in the structure.

Besides the enhanced cleaning of the textile, the double warp comprising the overlapping warp yarns makes the textile strong and resistant against wear. As the warps one above the other are at least partially offset the textile is stable. When a seam is formed to join the both ends of the textile together also the seam is stronger due to the warp yarns which are offset.

The industrial textile comprises a weft which comprises cross machine direction yarns. The cross machine direction yarns of the weft may be round yarns, i.e. their cross section is a circle, or they may be oval yarns, i.e. their cross section is oval. The cross machine direction yarns are usually monofilaments.

The cross machine direction yarns, i.e. the weft yarns are positioned in such a manner that the jet of the high pressure washing liquid is guided effectively through the textile. The jet has a certain angle in which it meets the first surface of the industrial textile. The jet may originate, for example, from a high pressure cleaner which is known as such at paper or board machines. The surface area which the jet meets is minimized by positioning the weft yarns at least on two different levels in the thickness direction of the industrial textile, i.e. the industrial textile has a predetermined rotating direction and a part of the weft yarns are behind other weft yarns in respect of the jet of the high pressure washing liquid.

The position of the weft yarns is controlled by the weave. The yarns of the first warp and the yarns of the weft bind themselves to each other according to a first predetermined pattern, and the yarns of the second warp and the yarns of the weft bind themselves to each other according to a second predetermined pattern.

According to one embodiment, it is beneficial to have a granular texture on the first side of the industrial textile because dirt does not fill up such surface easily. In other words, there are a lot of contact points on the first surface of the industrial textile but less contact area. The granular texture is achieved by short yarn floats. For example, the first predetermined pattern may be formed in such a manner that the yarns of the first warp and the yarns of the weft bind to each other so that the yarns of the first warp repeatedly pass over two yarns of the weft and under two yarns of the weft. The yarns of the first warp next to each other are arranged in such a manner that when a coincidentally selected warp yarn is under the weft yarns the warp yarn next to the coincidentally selected warp yarn is above the weft yarns. This results in the granular texture on the first surface, i.e. the surface of the textile looks like being covered by grains.

According to the embodiment described above, the second predetermined pattern may be formed in such a manner that the yarns of the second warp and the yarns of the weft bind to each other so that the yarns of the second warp repeatedly pass above one weft yarn and under three weft yarns. The yarns of the second warp next to each other are arranged in such a manner that when a coincidentally selected warp yarn is above the weft yarn the warp yarn next to the coincidentally selected warp yarn is above the second weft yarn as from the weft yarn above which the coincidentally selected warp yarn is. The weft yarn over which the yarn of the second warp passes is the second weft yarn over which the yarn of the first warp passes.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1:
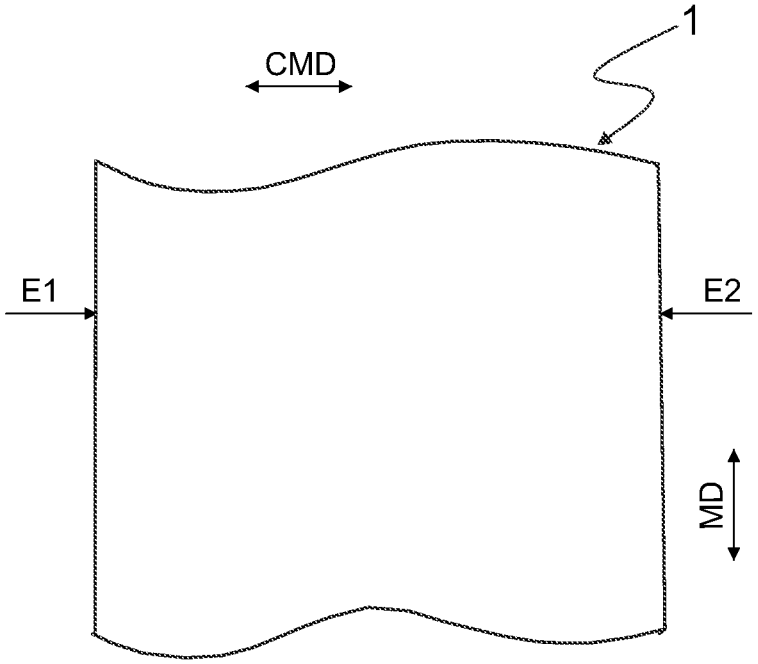
FIG. 1 shows a view from above explaining directions of an industrial textile.

FIG. 1 shows an industrial textile 1 from above. A first surface of the industrial textile 1 is up. The industrial textile 1 has a cross machine direction CMD and a machine direction MD. The cross machine direction CMD corresponds to a weft direction and the machine direction corresponds to a warp direction, i.e. a longitudinal direction of the industrial textile 1. The industrial textile 1 extends from a first edge E1 to a second edge E2.

Figure 2:
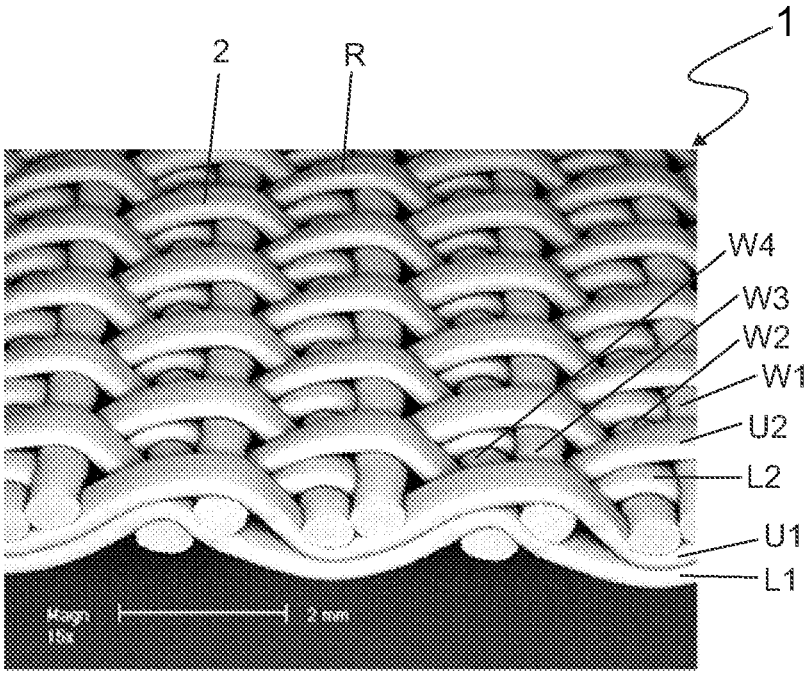
FIG. 2 shows an industrial textile in a perspective view.

FIG. 2 shows an industrial textile 1 in a perspective view with the first surface up. The industrial textile 1 comprises yarns U1 and U2 of the first warp, and yarns L1 and L2 of the second warp. The yarns U1 and L1 are essentially one upon the other but the yarns U2 and L2 are offset, i.e. the yarn U2 is shifted laterally in respect of the yarn L2. However, it is possible that also the yarns U1 and L1 are offset. The yarns U1, U2, L1 and L2 are usually monofilament yarns and they may be flat yarns. The warp cover of each warp is preferably from 75 to 95%. For example, a flat warp yarn may have a width of 0.75 mm and there may be 230 warp yarns per 100 mm, 115 yarns in each warp. The warp cover is then 0.75 mm×115/100 mm=86%.

The industrial textile 1 also comprises yarns W1, W2, W3 and W4 of the weft. The yarns W1, W2, W3 and W4 are usually monofilament yarns and they may be round or oval yarns. The above-mentioned elements are repeated in the industrial textile 1 so it is adequate to describe how they are bound.

The yarns U1, W1, W2, W3 and W4 bind to each other according to a first predetermined pattern so that the yarn U1 repeatedly passes over the yarns W3 and W4 and under the yarns W1 and W2. The yarn U2 next to the yarn U1 repeatedly passes under the yarns W3 and W4 and over the yarns W1 and W2. This results in the granular texture on the first surface, as seen in FIG. 1. An individual grain is marked by number 2.

The yarns L1, W1, W2, W3 and W4 bind to each other according to a second predetermined pattern so that the yarn L1 repeatedly passes over the yarn W4 and under the yarns W1, W2 and W3. The yarn L2 next to the yarn L1 repeatedly passes over the yarn W2 and under the yarns W1, W3 and W4.

The yarns W1 and W2 are in the same shed in respect of the first predetermined pattern as well as the yarns W3 and W4 are in the same shed in respect of the first predetermined pattern. As the yarn L1 passes over the yarn W4 and the yarn L2 passes over the yarn W2 the yarns W2 and W4 are forced downwards in respect of the yarns W1 and W3. The weft yarn W3 and the weft yarn W4 with the warp yarn L1 support the first warp yarn U1 underneath as well as the weft yarn W1 and the weft yarn W2 with the warp yarn L2 support the second warp yarn U2 underneath. As every other yarn of the first warp (U1 or U2) passes over two weft yarns (W1 and W2; or W3 and W4) and every other yarn of the second warp (L1 or L2) passes over one weft yarn (W2 or W4) a continuous ridge R is formed. The ridge extends from the first edge E1 to the second edge E2.

Figure 3:
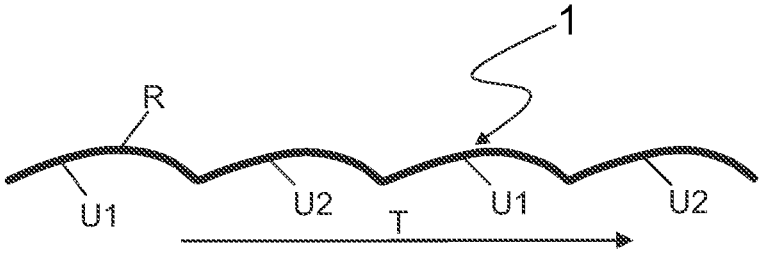
FIG. 3 shows the outline of the first surface of the industrial textile of FIG. 2.

FIG. 3 shows the outline of the first surface of the industrial textile 1 in the longitudinal direction of the industrial textile 1. The rotating direction of the textile 1 is illustrated by arrow T. The outline of the first surface is formed of sequential asymmetric ridges R. The outline is formed of the parallel warp yarns U1 and U2.

Figure 4:
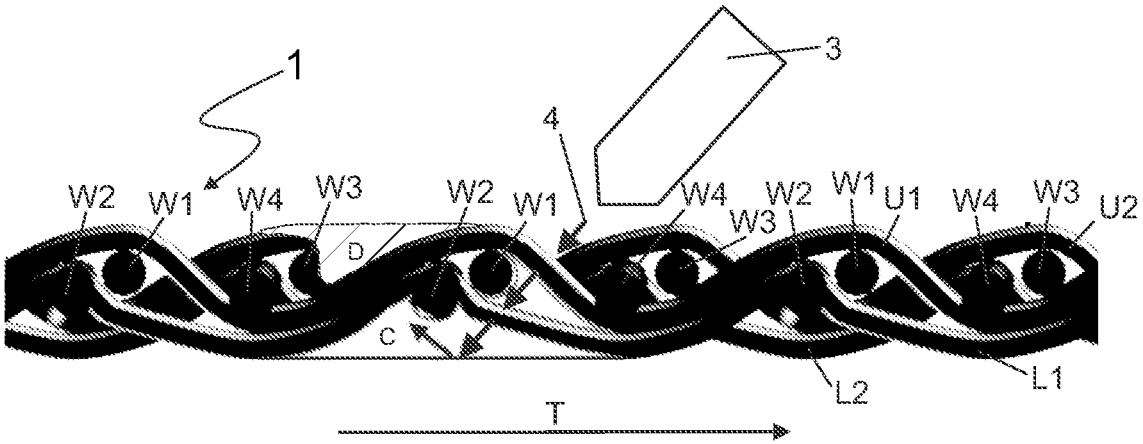
FIG. 4 shows a cross section of the industrial textile of FIG. 2.

FIG. 4 shows a cross sectional view of the industrial textile 1 of FIG. 2 during a washing process. The weave, i.e. how the yarns bind themselves, is described in connection with FIG. 2. In FIG. 4, there is a cleaning head 3 which directs a high pressure jet 4 of washing liquid towards the industrial textile 1. The industrial textile 1 has the predetermined rotating direction T. As the jet 4 hits the industrial textile 1 the washing liquid penetrates into the textile 1 through channels which are formed in the textile 1 by reason of the warp yarns which are offset, i.e. the yarns U2 and L2 in FIG. 2. There is a space C on the second side of the textile 1. The space C makes it possible that the washing liquid penetrates through the whole structure of the textile 1.

The weft yarns W1, W2, W3 and W4 are positioned in such a manner that the surface area of the textile 1 which is met by the jet 4 is minimized, thus maximizing the amount of the washing liquid which penetrates into the industrial textile 1. The weft yarns W1, W2, W3 and W4 lead the jet 4 through the textile 1.

There is a space D on the first surface of the industrial textile 1. Negative pressure prevails in the space D due to the shape of the running path of the warp yarns and the positioning of the weft yarns. The negative pressure enhances removing and collecting dirt and the residues of the washing liquid. The asymmetric running path of the warp yarns U1, U2 on the first surface of the industrial textile 1 diminishes the wear and the fibrillation of the warp yarns.

It will be obvious to a person skilled in the art that, as the technology advances, the inventive concept can be implemented in various ways. The invention and its embodiments are not limited to the examples described above but may vary within the scope of the claims.

The invention claimed is:

1. An industrial textile having a longitudinal direction and a cross direction and a first surface and a second surface, the industrial textile extending in the cross direction from a first edge to a second edge, the industrial textile comprising:

a double warp, the double warp comprising a first warp comprising first machine direction yarns and a second warp comprising second machine direction yarns, the yarns of the first warp being arranged above the yarns of the second warp and at least part of the yarns of the first warp are shifted laterally in respect of the yarns of the second warp, a weft comprising cross machine direction yarns the yarns of the first warp and the yarns of the weft bind themselves to each other according to a first predetermined pattern, the yarns of the second warp and the yarns of the weft bind themselves to each other according to a second predetermined pattern, and the first predetermined pattern and the second predetermined pattern form a textile structure which comprises the cross machine direction yarns at least on two different levels in the thickness direction of the industrial textile, wherein the first predetermined pattern is as follows: the yarns of the first warp and the yarns of the weft bind to each other in such a manner that the yarns of the first warp repeatedly pass over two yarns of the weft and under two yarns of the weft, the yarns of the first warp next to each other being arranged in such a manner that when a coincidentally selected warp yarn is under the weft yarns the warp yarn next to the coincidentally selected warp yarn is above the weft yarns, thus resulting in a granular texture on the first surface;

the second predetermined pattern is as follows: the yarns of the second warp and the yarns of the weft bind to each other in such a manner that the yarns of the second warp repeatedly pass above one weft yarn and under three weft yarns, the yarns of the second warp next to each other being arranged in such a manner that when a coincidentally selected warp yarn is above the weft yarn the warp yarn next to the coincidentally selected warp yarn is above the second weft yarn as from the weft yarn above which the coincidentally selected warp yarn is;

the weft yarn over which the yarn of the second warp passes is the second weft yarn over which the yarn of the first warp passes.

2. The industrial textile according to claim 1, wherein the first weft yarn over which the yarns of the first warp passes, has a larger cross section compared to the second weft yarn.

3. The industrial textile according to claim 1, wherein the warp cover of each warp is from 75 to 95%.

4. The industrial textile according to claim 1, wherein the first machine direction yarns of the first warp are flat yarns.

5. The industrial textile according to claim 1, wherein the second machine direction yarns of the second warp are flat yarns.

6. The industrial textile according to claim 1, wherein the cross machine direction yarns of the weft are round or oval yarns.

* * * * *